United States Patent [19]

Myers et al.

[11] 4,261,448

[45] Apr. 14, 1981

[54] CARRYING AND SUSPENSION SYSTEM FOR SOFT LUGGAGE

[75] Inventors: Jay E. Myers, Laguna Beach, Calif.; M. Todd Myers, New York, N.Y.

[73] Assignee: Andiamo Inc., Santa Ana, Calif.

[21] Appl. No.: 91,805

[22] Filed: Nov. 6, 1979

[51] Int. Cl.[3] ..... A45C 13/26

[52] U.S. Cl. ..... 190/43; 190/27; 190/44; 190/58 R

[58] Field of Search ..... 190/43, 44, 58 R, 26, 190/27

[56] References Cited

U.S. PATENT DOCUMENTS

| | | | |
|---|---|---|---|
| 337,367 | 3/1886 | Brockway | 190/58 R |
| 356,528 | 1/1887 | Douglas | 190/27 |
| 574,456 | 1/1897 | Seitz | 190/58 A |
| 652,473 | 6/1900 | Cole | 190/27 |
| 841,620 | 1/1907 | Buchanan | 190/27 |
| 1,041,170 | 10/1912 | Ross | 190/58 R |
| 1,638,753 | 8/1927 | Stein | 190/58 R |
| 2,425,035 | 8/1947 | Garnett | 190/43 |

FOREIGN PATENT DOCUMENTS 531573 9/1954 Belgium .

*Primary Examiner*—Donald F. Norton

*Attorney, Agent, or Firm*—Gausewitz, Carr, Rothenberg & Edwards

[57] ABSTRACT

A travel bag is formed from a rectangular, pliable fabric container to which is attached a carrying and suspension system including a single handle connected to a support plate adjacent the upper wall of the container. When the bag is lifted by its handle, a significant portion of the lifting force is transmitted to horizontally extending straps, sewn along their lengths to the sidewalls of the container, via vertically extending straps bearing on the support plate and anchored to the horizontal straps. The carrying and suspension system thus distributes lifting stress across the widths of the container sidewalls, thereby eliminating localized, vertical stress areas along the sidewalls. The side and end walls of the container are nonreinforced and the vertical straps may be adjusted to vertically and horizontally compress the container against objects therein to restrain them from shifting within the container when it is only partially loaded.

21 Claims, 4 Drawing Figures

CARRYING AND SUSPENSION SYSTEM FOR SOFT LUGGAGE

BACKGROUND OF THE INVENTION

1. Field of the Invention

This invention relates generally to luggage, and more particularly to a carrying and suspension system for soft luggage. 2. Description of Prior Art The advantages of soft luggage, such as light weight and small storage space requirements when not in use have, in the past, been somewhat offset by certain problems associated with the carrying means attached to such luggage. An example of those problems is the popular nylon fabric travel bag which has a zippered opening extending along its top and end walls, and two carrying straps each having end portions stitched to and extending vertically down a sidewall of the bag. A central longitudinal portion of each strap is not connected to the bag but forms one of two carrying loops on opposite sides of the bag. To carry the bag, the loops are gathered together over the top of the bag to form a central carrying handle.

When the bag is lifted by its carrying loops, all of the lifting force, and thus the thread-to-fabric carrying stress, is concentrated along four rather narrow vertically extending and laterally separated areas on the fabric. Especially when the bag is large and heavily loaded, this carrying stress concentration can have a tendency to cause the fabric to rip along such narrow stress areas. Additionally, the carrying straps have a tendency to dig into the bag, creating unsightly bulges between the straps and imposing a concentrated lateral load on the bag's contents adjacent the connected strap portions, potentially damaging or displacing the contents. Such displacement of the bag's contents can also damage its zipper.

Conventional strap loops do not form a particularly comfortable carrying handle for heavily loaded bags which must be carried for more than short distances, being rather narrow and coming together at an angle from opposite sides of the bag. Moreover, unless joined when not in use, the loops often droop outwardly along the sides of the bag and are easily snagged in automated luggage handling apparatus.

For purposes of shape retention, a conventional soft travel bag is reinforced by means of wires or rods extending around the perimeters of its sidewalls or by rigid plates connected to its end walls. Such reinforcement greatly hinders the ability of the bag to be compressed against its contents (by, for example, tightening straps fastened to the bag) to keep them from shifting around in the bag when it is only partially loaded. Sidewall reinforcing rods substantially preclude any significant vertical compression of the bag, while end wall reinforcing plates substantially preclude any significant sidewall-to-sidewall or vertical bag compression. In either case, despite the fact that pliable material is used to construct the body of the bag, its shape adjustability is negligible at best. Thus, like hard luggage, unless the conventional soft travel bag is fully packed, its contents can easily shift around in it, thus wrinkling or damaging them, as the bag is being transported to its destination.

Accordingly, it is an object of the present invention to eliminate or minimize above-mentioned and other problems.

SUMMARY OF THE INVENTION

In accordance with the present invention, a specially designed carrying and suspension system is attached to a container of a pliable material to form a travel bag having comfortable carrying means and to greatly reduce carrying stress on the container.

The carrying and suspension system includes a substantially rigid supporting member positioned adjacent an upper portion of the container and a handle connected to the supporting member. Below the supporting member are horizontally extending, elongated flexible bridging members which are fastened along at least major portions of their lengths to a downwardly extending wall section of the container. Vertically extending lower longitudinal portions of a plurality of elongated, flexible suspension members overlie the container in a laterally spaced relationship around it and are connected to the bridging members. Means are provided for associating the upper portions of the suspension members with the supporting member so that a lifting force on the handle is transmitted through the supporting member and then downwardly through the suspension members to the bridging members. The bridging members then distribute the downwardly transmitted lifting force laterally along their lengths to the container.

This force redistribution eliminates lifting stress along narrow vertical areas commonly associated with conventional soft luggage, thus increasing the durability of the container. If further greatly reduces the tendency of the suspension members to dig into the container when it is lifted, potentially shifting or damaging its contents.

Unlike conventional pieces of soft luggage, the downwardly extending wall section of the travel bag is not reinforced, but is left entirely flexible. Importantly, this allows the shape of the bag to be compressed both vertically and laterally to bring the container walls into contact with the bag's contents to restrain them from shifting within the bag when it is only partially loaded. Means are provided for adjusting the suspension members to accomplish such compression of the container.

Despite the absence of reinforcing members in the downwardly extending wall section, the novel suspension system gives the assembled travel bag a surprisingly great degree of shape retention whether it is fully or only partially loaded. Additionally, by allowing the downwardly extending wall section to remain entirely flexible it is not as easily damaged by rough handling as it would be if it was held in place by supplementary reinforcing members.

Because the handle is connected to the supporting member and not directly to the suspension members, as is the case in conventional soft luggage carrying systems, the handle may be constructed in a wide variety of comfortable configurations and is closely adjacent the container at all times. This greatly reduces the possibility that the travel bag will become caught in automated luggage handling apparatus. The single handle may be quickly grasped and used without the necessity of gathering or fastening together separate carrying strap loops. While a substantial improvement over conventional soft luggage carrying systems, the carrying and suspension system of the invention does not significantly add to the weight or cost of such luggage or detract from its appearance. It is easily and quickly attachable to flexible containers having a wide variety of shapes, sizes, and materials, and may be formed from readily available standard components.

DETAILED DESCRIPTION OF THE EMBODIMENT

Figure 1:
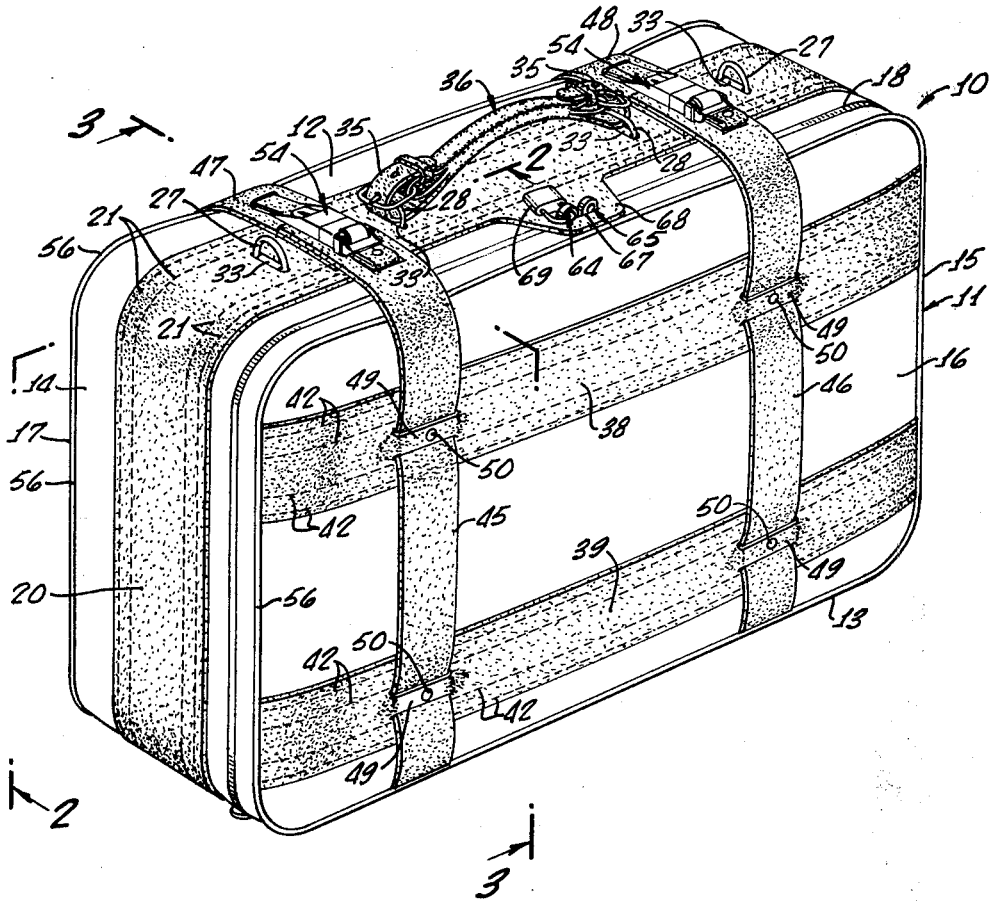
FIG. 1 is a perspective view of a travel bag constructed in accordance with principles of the invention.

A travel bag 10 constructed in accordance with principles of the invention is depicted in FIG. 1 and includes a rectangular, pliable fabric container 11. The container 11 has elongated, generally parallel top and bottom walls 12 and 13, substantially shorter, generally parallel opposite end walls 14 and 15, and generally parallel opposite sidewalls 16 and 17. An offset, zippered opening 18 extends along the top wall 12 and down the end walls 14 and 15 adjacent the sidewall 16.

To the container 11 is attached a novel carrying and suspension system which includes a relatively wide leather strap or flexible suspension member 20 which outwardly overlies the container, extending longitudinally across its top wall 12 and down its end walls 14 and 15. The strap 20 is generally centered between the sidewalls 16 and 17 and is laterally spaced slightly inwardly of the zippered opening 18. Continuous lines of stitches 21, along the side edges of the strap 20, fasten it along its length to the container 11.

Figure 3:
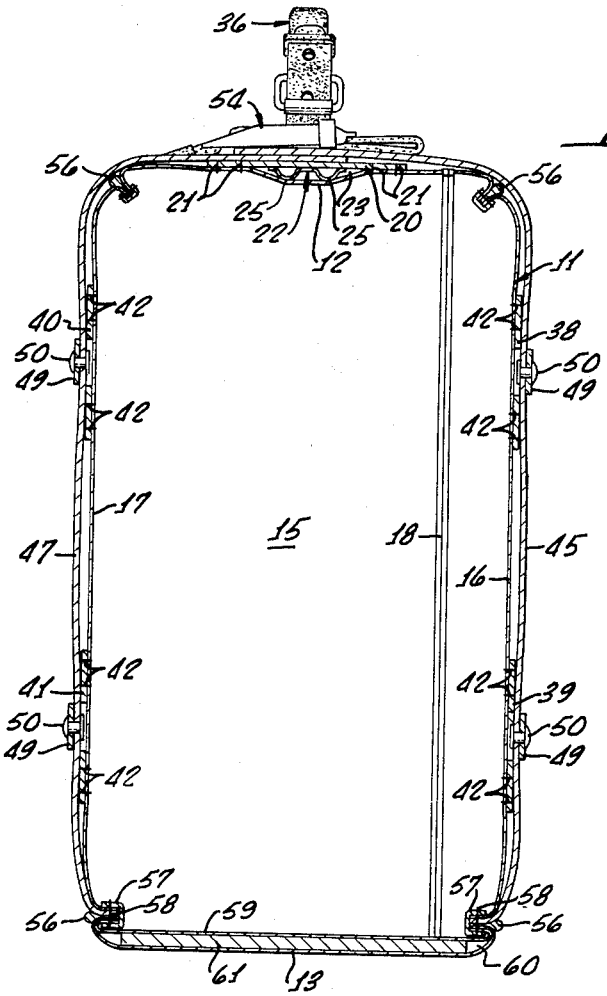
FIG. 3 is a cross-sectional view of the travel bag taken along line 3—3 of FIG. 1.

An elongated, substantially rigid supporting member in the form of a rectangular metal support plate 22, which is somewhat narrower than the strap 20, extends longitudinally along substantially the entire length of the top wall 12 between the top wall and the horizontal portion of the strap 20. The support plate 22 is retained in this position by the stitch lines 21 which are spaced outwardly of its side edges as best indicated in FIG. 3. The stitch lines 21 form a longitudinally extending pocket 23 between the strap 20 and the top wall 12 which receives the plate 22.

Figure 2:
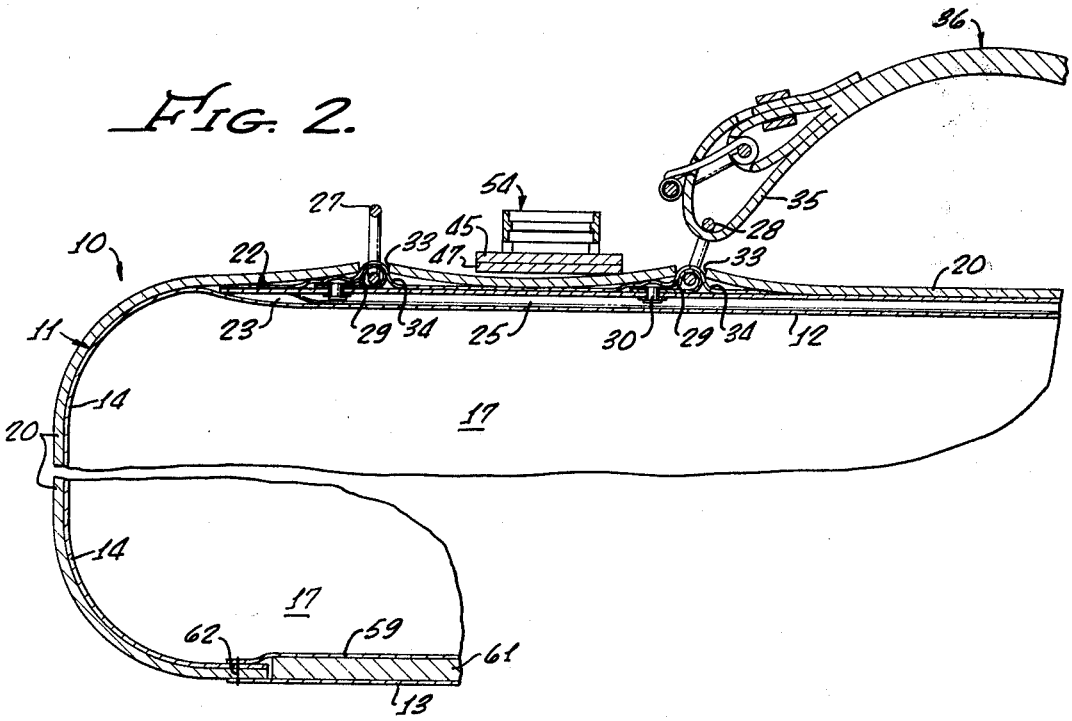
FIG. 2 is a fragmentary cross-sectional view of portions of the travel bag taken along line 2—2 of FIG. 1.
Figure 4:
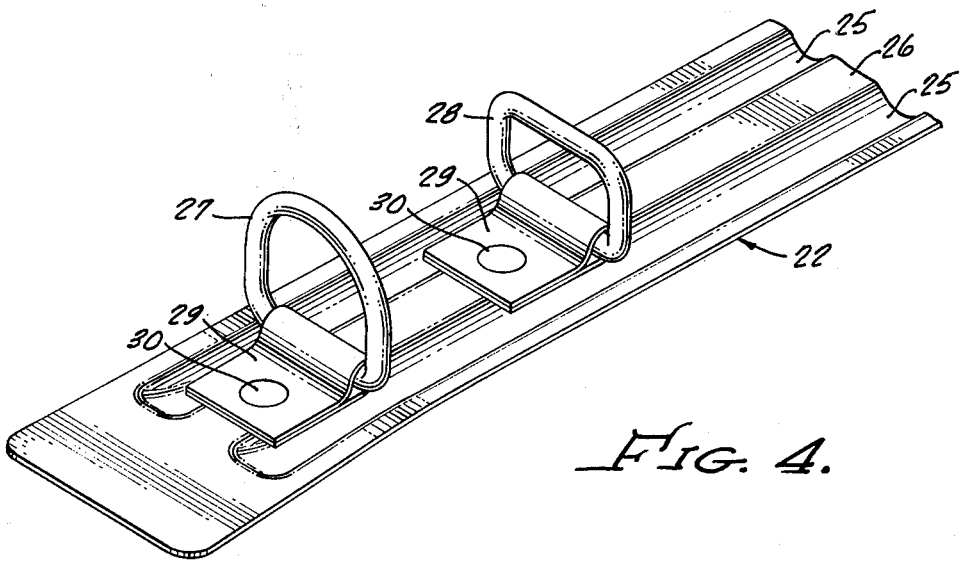
FIG. 4 is a greatly enlarged, fragmentary perspective view of the support plate connected to an upper portion of the travel bag.

Referring to FIGS. 2, 3 and 4, the support plate 22 has two longitudinally extending, downwardly projecting corrugations 25 formed in it which extend along substantially its entire length. The corrugations, which stiffen the support plate 22, are positioned adjacent its side edges and on opposite sides of a central flat portion 26. Adjacent each end of the support plate 22 metal loops 27 and 28 are pivotally connected to it by means of thin metal mounting brackets 29 fastened to the upper surface of the central portion 26 by rivets 30. The loops 27 are spaced longitudinally outwardly of the loops 28.

With the support plate 22 in place in its pocket beneath the horizontal portion of the strap 20, the loops 27 and 28 project upwardly through four transverse slots 33 formed in a central lateral portion of the strap 20. Strips of tape 34 (FIG. 2) are passed longitudinally through the loops 27 and 28 and adhered to the upper surfaces of the mounting brackets 29 and rivets 30 to form a smooth interface between the brackets 29 and rivets 30 and the portion of the strap 20 above them.

The metal loops 28 which, like the loops 27, project upwardly of the strap 20, receive opposite buckled end loops 35 of a single, central leather handle 36. The handle 36 is thus connected to the support plate 22 and not to the fabric of the container 11. Therefore, a lifting force on the handle 36 is transmitted directly to the support plate 22. The upwardly projecting metal loops 27 may be used as connection points for opposite ends of a shoulder strap (not shown) as an optional way of carrying the travel bag 10.

To distribute a lifting force on the handle 36 across the widths of the sidewalls 16 and 17 in a manner described below, horizontal flexible leather interconnecting or bridging straps 38 through 41, which are somewhat narrower than the strap 20, are fastened along their lengths to the outer surface of the sidewalls 16 abd 17 by continuous lines of stitches 42 extending along the side edges of these straps. The interconnecting straps 38 and 39, and 40 and 41, respectively, extend longitudinally across the entire widths of the sidewalls 16 and 17. The straps 38 and 39 on one side of the bag, and 40 and 41 on the other side, are laterally spaced apart from each other and are positioned on approximately the vertical quarter points of the sidewalls. Thus, for example, the straps 38 and 39, respectively, are spaced inwardly from the top and bottom walls 12 and 13 by approximately one-fourth of the height of the sidewall 16.

Lower longitudinal portions of still narrower leather suspension straps 45 and 46, and 47 and 48, overlie and extend vertically along the entire height of the sidewalls 16 and 17, respectively. The suspension straps 45 and 46, and 47 and 48, respectively, transversely intersect the horizontal interconnecting straps at approximately the horizontal quarter points of the sidewalls. The suspension straps 45 through 48 are positioned outwardly of the interconnecting straps which they intersect, but pass through horizontally extending loops 49 formed in the interconnecting straps. Rivets 50 or other suitable fasteners passing sequentially through the loops 49, the suspension straps and the container sidewalls firmly anchor the intersecting suspension and interconnecting straps at their junctures.

Unlike the interconnecting straps 38 through 41, the lower longitudinal portions of the suspension straps 45 through 48 are not fixed to the container sidewalls. Each of the four sidewall suspension straps is fastened to the container only at its lower end and at the rivets 50.

The upper ends of the suspension straps or flexible suspension members 45 through 48, which are not fastened to the container, are sized so that the upper end portions of the opposite suspension strap pairs 45 and 47, and 46 and 48, may be removably joined over the top portion of the strap 20 by suitable adjustable means such as buckle assemblies 54. With the buckles unfastened, the zippered opening 18 may be opened and the portion of the container 11 containing the sidewall 16 opened outwardly to provide access to the interior of the container.

Referring to FIG. 2, the edges of the container sidewalls, top and bottom walls, and end walls are folded inwardly and joined to fabric piping 56, which extends around the perimeter of each of the sidewalls, by means of folded trim strips 57 and lines of stitching 58 within the container 11. The lower ends of the suspension straps 45 through 48 are also secured to the lower edges of the sidewalls by the stitches 58 as illustrated in FIG. 3. Similarly, the ends of the interconnecting straps 38 through 41 are bent inwardly and connected to the interior trim strips 57 by the lines of stitches 58.

A fabric strip 59 is fastened to the lower surfaces of the trim strips 57 above the bottom wall 13 by the stitches 58 and defines with the bottom wall a pocket 60. The pocket 60 extends along the length of the bottom wall 13 and receives an elongated rectangular wooden plate 61 which functions as a bottom reinforcing member. The bottom ends of the suspension strap 20 are each continued underneath the container 11 for a short distance and are fastened to the bottom wall 13 by lines of stitches 62. None of the suspension straps is connected directly to the lower plate 61.

With the upper end portions of the suspension straps 45 through 48 buckled together as illustrated in FIG. 1 and tightened against the horizontal upper portion of the strap 20, the specially designed carrying and suspension system is ready for use and operates as follows.

When the bag 10 is lifted by its handle 36, the lifting force is shifted outwardly through the upper support plate 22 and distributed among the six downwardly extending portions of the four suspension straps 45 through 48 and the suspension strap 20 spaced around its perimeter. The lifting force in the vertical portions of the strap 20 is then transmitted to the container fabric along the height of the end walls 14 and 15 by the lines of stitches 21.

However, the lifting force borne by the suspension straps 45 through 48 is not transmitted to the sidewalls 16 and 17 along localized, vertically extending stress lines at the positions of the vertically extending straps. Because the suspension straps 45 through 48 are firmly anchored to the interconnecting straps 38 through 41 as previously described, the lifting force in the vertical straps 45 through 48 is shifted laterally across the widths of the sidewalls through the interconnecting straps. The redistributed force is then transmitted to the sidewall fabric through the horizontally extending lines of stitches 42. This lateral shifting eliminates the concentrated, vertically extending stress lines on the sidewalls often associated with conventional soft luggage construction by taking advantage of the fact that the width of each of the sidewalls is substantially greater than its height.

Stated otherwise, as the bag is lifted, a portion of the weight of the bag and its contents exerts a downward force on the interconnecting straps 38 through 41 through their lines of stitches 42. The force on the interconnecting straps is transmitted directly through the sidewall suspension straps 45 through 48, through the support plate 22, and, thence, to the handle 36. There are, therefore, no vertically extending stress lines on the sidewalls beneath the sidewall suspension straps. Thus, unlike the strap-to-fabric carrying systems on many conventional soft-sided travel bags, the carrying stress on the fabric of the container 11 is distributed around substantially its entire horizontal perimeter, including its end walls. This unique carrying stress redistribution tends to prolong the life of the container fabric and also helps to protect the container's contents from concentrated stress along the vertically extending sidewall straps.

The combination of the support plate 22 and the novel stress-reducing suspension system which depends from its perimeter allows the use of the single, central handle 36 instead of the much less comfortable and less convenient two-piece handle of conventional soft luggage.

It is a significant feature of the invention that, unlike conventional soft travel bags, no reinforcing members are used to stiffen or position the side and end walls of the container. More specifically, no rods or wires extend around the perimeters of the sidewalls and no plates are fastened to the end walls. Therefore, the container side and end walls in the assembled travel bag remain substantially entirely flexible. This feature allows the container to be compressed not only laterally (i.e., from sidewall to sidewall) but vertically (i.e., from top wall to bottom wall) as well to adjust the shape of the container and thus position its walls against the bag's contents to restrain them from shifting within the bag.

Such container shape adjustment is accomplished in the uniquely adjustable suspension system by simply tightening or loosening the buckles 54. Tightening them draws the top and bottom container walls, and the sidewalls, closer together. This is not only adjustably compresses the container vertically and laterally, but helps to relieve stress on the zipper 18 as well when the bag is fully loaded. Additionally, the use of the buckles 54 allows the suspension straps 45 through 48 to be adjusted to compensate for the position and size of the contents of the container so that each of the strap pairs 45 and 47, and 46 and 48, bears against the support plate 22 when the bag is lifted, even when the bag is only partially loaded.

The illustrated suspension system, by virtue of its ability to smoothly distribute a central, concentrated lifting force around substantially the entire horizontal perimeter of the pliable container, improves the shape retention characteristics of the travel bag to a surprising degree, whether the bag is fully or partially loaded. Yet it does so despite the absence of reinforcement of the container side and end walls. Thus, the usual compromise in soft luggage construction between shape retention and shape adjustability is greatly diminished under the present invention.

The horizontal interconnecting straps also greatly reduce unsightly bulges between the vertical straps, commonly associated with conventional soft luggage when packed, without the necessity of such additional reinforcement.

If desired, the lower reinforcing plate 61 can be omitted. In such case, the only substantially rigid reinforcing component in the travel bag would be the upper support plate 22, and the bottom container wall would also be left substantially entirely flexible.

The lower longitudinal portions of the suspension straps 45 through 48 may alternatively be fastened along their lengths to the sidewalls 16 and 17 by lines of stitches along the side edges of these straps. Even with such additional vertical lines of stitches, the horizontally extending interconnecting straps still function to greatly reduce concentrated vertical stress lines on the container sidewalls.

Although a conventionally shaped travel container has been illustrated and described, the carrying and suspension system of the invention is applicable to a wide variety of containers having other shapes (including nonrectangular shapes) and sizes and may be easily modified to accommodate them. For example, if a shorter container were to be used, the bottom interconnecting straps 39 and 41 could be eliminated, if desired, since the side wall areas and the lifting load would be reduced. Additionally, further interconnecting straps could be added to a taller container, if desired.

It is not necessary to the invention that the strap 20 extend entirely across the top wall of the container, although that configuration enhances the appearance of the assembled travel bag. All that is necessary is that its downwardly extending portions be connected to the support plate 22. Thus, if desired, a large central longitudinal portion of the strap 20 between the ends of the support plate 22 could be omitted.

The suspension and interconnecting straps could be alternatively formed from nylon webbing or other suitably strong material, and the plates 22 and 61 could be of other substantially rigid materials.

Moreover, each of the vertically extending straps could be terminated above the bottom wall of the container or continued around it and joined beneath the bottom wall or connected to the lower plate 61 to provide still further support for the container.

The zippered opening 18 is provided with two movable zipper elements 64 and 65 which, from their central position illustrated in FIG. 1 (in which the opening 18 is closed), may respectively be moved to the left and right along the opening 18 to open the bag. In their central position, the elements 64 and 65 may be interlocked to preclude such movement. A portion 66 of the interlocked elements projects upwardly through a slot 67 in a central, laterally projecting tab 68, on the strap 20, which overlies the joined elements. A lock 69 attached to the upwardly projecting element portion above the tab 67 maintains the zipper elements in their interlocked relationship and prevents the bag from being opened.

The foregoing detailed description is to be clearly understood as given by way of illustration and example only, the spirit and scope of this invention being limited solely by the appended claims.

What is claimed is:

1. A travel bag comprising:

(a) a container of a pliable material having an opening therein and means for closing said opening;

(b) a substantially rigid supporting member adjacent an upper portion of said container;

(c) a handle connected to said supporting member;

(d) a plurality of elongated, flexible suspension members, each having an upper longitudinal portion, and a vertically extending lower longitudinal portion below said supporting member, said lower longitudinal portions being in a laterally spaced relationship around said container;

(e) an elongated, horizontally extending flexible interconnecting member;

(f) means for connecting said interconnecting member to said lower portions of said suspension members;

(g) means for fastening said interconnecting member to said container along at least a major portion of the length of said interconnecting member; and (h) means for associating said upper portions of said suspension members with said supporting member so that at least a portion of a lifting force on said handle is transmitted through said supporting member to said interconnecting member and, thence, to said container along said major portion of said length of said interconnecting member.

2. The travel bag of claim 1 wherein said upper portion of said container comprises a top wall of said container, said container further comprises a nonreinforced wall section extending downwardly from said top wall, whereby said travel bag may be compressed both vertically and horizontally to position said top wall said downwardly extending wall section against objects in said container to restrain them from shifting therein, and said associating means (h) further includes means for adjusting said upper portions of said suspension members to vertically and horizontally compress said travel bag.

3. The travel bag of claim 1 wherein each of said lower portions of said suspension members has a substantial longitudinal portion which is not connected to said container.

4. The travel bag of claim 1 wherein said container has a vertically extending sidewall, said interconnecting member extending longitudinally across substantially the entire horizontal extent of said sidewall.

5. The travel bag of claim 1 wherein said suspension and interconnecting members are straps, said means for connecting said interconnecting member to said lower portions of said suspension members comprises fasteners, and said means for fastening said interconnecting member to said container comprises stitches.

6. The travel bag of claim 5 wherein said suspension members intersect said interconnecting member and wherein said fasteners extend through said intersecting suspension and interconnecting members at their junctures.

7. The travel bag of claim 1 wherein said suspension and interconnecting members overlie the outer surface of said container.

8. The travel bag of claim 1 further comprising at least one additional elongated, horizontally extending flexible interconnecting member, means for fastening said additional interconnecting member to said container along at least a major portion of the length of said additional interconnecting member, and means for connecting said additional interconnecting member to said suspension members, said interconnecting member being laterally spaced apart from said additional interconnecting member.

9. The travel bag of claim 1 wherein said container has a pair of opposite sidewalls each having said lower longitudinal portions of a pair of said suspension members extending generally along horizontal quarter points thereof, said handle being positioned laterally between the suspension members of each of said pairs of suspension members, wherein said associating means (h) includes means for removably attaching the upper portion of one of said suspension members of one of said pairs to the upper portion of one of said suspension members of the other of said pairs, and means for removably attaching the upper portion of the other of said suspension members of said one of said pairs to the upper portion of the other of said suspension members of said other of said pairs across said upper portion of said container so that the attached upper portions of said pairs of said suspension members bear against said supporting member when said travel bag is lifted by said handle.

10. The travel bag of claim 9 including a plurality of said elongated, flexible interconnecting members fastened along their lengths to said container, and wherein each lower longitudinal portion of each of said pairs of suspension members is connected to at least one of said interconnecting members.

11. A travel bag comprising:

(a) a substantially rigid support plate;

(b) a handle connected to a central portion of said support plate;

(c) a plurality of flexible suspension straps extending longitudinally downwardly of said support plate in a laterally spaced relationship around it;

(d) means for associating said suspension straps with said support plate so that a lifting force on said handle is transmitted through said support plate to said suspension straps;

(e) at least one flexible bridging strap extending transversely of said suspension straps below said support plate;

(f) means for anchoring said bridging strap to said suspension straps;

(g) a container of a pliable material having an opening therein, means for closing said opening, a top wall adjacent said support plate, a bottom wall, a pair of opposite, generally parallel sidewalls, and a pair of opposite, generally parallel end walls; and (h) means for fastening said bridging strap to one of said sidewalls of said container along at least a major portion of the length of said bridging strap so that a lifting force on said handle is transmitted outwardly through said support plate to said suspension straps, downwardly through said suspension straps to said bridging strap, and is then distributed horizontally along said one of said sidewalls through said bridging strap.

12. The travel bag of claim 11 wherein said side and end walls of said container are nonreinforced, whereby said container may be compressed vertically and laterally against objects therein to restrain shifting of the objects when said container is only partially loaded, and wherein said associating means (d) further comprises means for adjusting said suspension straps to vertically and laterally compress said container.

13. The travel bag of claim 11 further comprising a reinforcing plate carried by said travel bag, said reinforcing plate being adjacent and extending along a substantial portion of said bottom wall of said container.

14. The travel bag of claim 11 wherein the distance between said end walls is substantially greater than the distance between said sidewalls, said suspension straps including a duality of said suspension straps extending along each of said sidewalls, and in which there are at least two of said bridging straps, one of which extends between and is anchored to the suspension straps of one of said dualities of said suspension straps, the other of which extends between and is anchored to the suspension straps of the other of said dualities of said suspension straps.

15. The travel bag of claim 11 further comprising an end wall suspension strap extending downwardly along each of said end walls, and means for fastening said end wall suspension straps along at least major portions of their lengths to said end walls.

16. The travel bag of claim 14 including at least four of said transversely extending bridging straps, each of said dualities of said suspension straps being anchored to two of said bridging straps which are laterally spaced apart from each other.

17. A travel bag comprising:

(a) a generally rectangular container of a pliable material having a top wall, a bottom wall, first and second nonreinforced opposite sidewalls, first and second nonreinforced opposite end walls, an opening extending along said top wall and said first and second end walls adjacent said first sidewall, and means for closing said opening;

(b) a first strap having a horizontally extending central longitudinal portion overlying said top wall, and opposite end portions overlying said end walls, said first strap being laterally positioned between said opening and said second sidewall;

(c) a second strap, said second strap overlying said first wall and extending horizontally across substantially the entire width of said first sidewall below said top wall;

(d) a third strap, said third strap overlying said second sidewall and extending horizontally across substantially the entire width of said second sidewall below said top wall;

(e) a fourth and a fifth strap each having an upper longitudinal portion, and a lower longitudinal portion overlying said first sidewall, said lower portions of said fourth and fifth straps extending vertically along said first sidewall, being generally parallel to each other and laterally positioned along approximately the horizontal quarter point of said first sidewall, said fourth strap being adjacent said first end wall and said fifth strap being adjacent said second end wall;

(f) a sixth and seventh strap each having an upper longitudinal portion, and a lower longitudinal portion overlying said second sidewall, said lower portions of said sixth and seventh straps extending vertically along said second sidewall, being generally parallel to each other and laterally positioned along approximately the horizontal quarter points of said second sidewall, said sixth strap being adjacent said first end wall and said seventh strap being adjacent said second end wall;

(g) means for adjustably and removably joining said upper longitudinal portions of said fourth and sixth straps, and said upper longitudinal portions of said fifth and seventh straps, over said horizontally extending central longitudinal portion of said first strap, whereby said container may be adjustably vertically and laterally compressed against objects therein to restrain shifting of the objects within said container;

(h) an elongated, substantially rigid support plate extending longitudinally between said first and second end walls beneath said central longitudinal portion of said first strap, said support plate being laterally positioned between said opening and said second sidewall and having a central longitudinal portion extending between said upper portions of said fourth and sixth straps and said upper portions of said fifth and seventh straps;

(i) a handle;

(j) means for connecting said handle to said central longitudinal portion of said support plate;

(k) means for fastening said first, second, and third straps along substantially their entire lengths to said container; and (l) means for connecting said lower portions of said fourth and fifth straps, and said lower portions of said sixth and seventh straps, respectively, to said second and third straps.

18. The travel bag of claim 17 further comprising:

(m) an eighth strap, said eighth strap overlying said first sidewall and extending horizontally across substantially the entire width of said first sidewall, said second and eighth straps being generally parallel and positioned approximately along the vertical quarter point of said first sidewall;

(n) a ninth strap, said ninth strap overlying said second sidewall and extending horizontally across substantially the entire width of said second sidewall, said third and ninth straps being generally parallel and positioned approximately along the vertical quarter points of said second sidewall;

(o) means for fastening said eighth and ninth straps along substantially their entire lengths to said container;

(p) means for connecting said lower longitudinal portions of said fourth and fifth straps to said eighth strap; and (q) means for connecting said lower longitudinal portions of said sixth and seventh straps to said ninth strap.

19. The travel bag of claim 17 or 18 wherein said central portion of said first strap has a pair of lateral slots formed therein above said central portion of said support plate, and wherein said means for connecting said handle to said support plate comprise a pair of substantially rigid loop members each being connected to said support plate and projecting upwardly through one of said slots, and means for connecting opposite ends of said handle to said loop members.

20. The travel bag of claim 17 or 18 further comprising a substantially rigid reinforcing plate carried by said travel bag adjacent said bottom wall, said reinforcing plate extending along substantially the entire length and width of said bottom wall.

21. The travel bag of claim 18 wherein said lower portions of said fourth, fifth, sixth, and seventh straps extend along substantially the entire height of said sidewalls, said travel bag further comprising means for fastening the lower ends of said lower longitudinal portions of said fourth, fifth, sixth, and seventh straps to said container.

* * * * *